US007485077B2

(12) United States Patent
Chen

(10) Patent No.: US 7,485,077 B2
(45) Date of Patent: Feb. 3, 2009

(54) WEIGHTLIFTING DEVICE

(76) Inventor: James Chen, No. 35, Tung-Hai Rd., Sha-Lu Chen, Taichung Hsien (TW)

( * ) Notice: Subject to any disclaimer, the term of this patent is extended or adjusted under 35 U.S.C. 154(b) by 84 days.

(21) Appl. No.: 11/642,367

(22) Filed: Dec. 19, 2006

(65) Prior Publication Data

US 2008/0146420 A1 Jun. 19, 2008

(51) Int. Cl.
*A63B 21/072* (2006.01)

(52) U.S. Cl. ..... 482/108; 482/106; 482/107

(58) Field of Classification Search ..... 482/93–95, 482/97, 98, 99, 106, 107, 108, 109, 908
See application file for complete search history.

(56) References Cited

U.S. PATENT DOCUMENTS 6,656,093 B2 12/2003 Chen ..... 482/108
2004/0005969 A1 1/2004 Chen ..... 482/107
2005/0277525 A1* 12/2005 Liu ..... 482/107
2006/0135328 A1* 6/2006 Doudiet ..... 482/107
2007/0184945 A1* 8/2007 Lin ..... 482/107

* cited by examiner

*Primary Examiner*—Loan H Thanh
*Assistant Examiner*—Allana Lewin
(74) *Attorney, Agent, or Firm*—DLA Piper LLP (US)

(57) ABSTRACT

A weightlifting device includes a handle member, an adjustable member, a set of weight plates, and a restricting unit. The handle member has a tubular end portion. The adjustable member extends into the end portion of the handle member, and is movable axially relative to the handle member. The weight plates are attached removably to the adjustable member. The restricting unit is operable so as to arrest and permit axial movement of the adjustable member relative to the handle member.

16 Claims, 12 Drawing Sheets

WEIGHTLIFTING DEVICE

BACKGROUND OF THE INVENTION

1. Field of the Invention

This invention relates to a weightlifting device, more particularly to a weightlifting device that simplifies attachment and detachment of weight plates to and from a handle member.

2. Description of the Related Art

A conventional dumbbell includes a handle member, a set of weight plates that are attached removably to the handle member, and a pair of spin locks, each of which is threadedly engaged to a respective one of opposite end portions of the handle member for retaining the weight plates on the handle member.

The aforementioned conventional dumbbell is disadvantageous in that attachment and detachment of the weight plates to and from the handle member is relatively complex.

SUMMARY OF THE INVENTION

Therefore, the object of the present invention is to provide a weightlifting device that can overcome the aforesaid drawback of the prior art.

According to the present invention, a weightlifting device includes an exercising weight that includes a handle member, an elongated adjustable member, a set of weight plates, and a restricting unit. The handle member has a tubular end portion. The adjustable member extends into the end portion of the handle member, and is movable axially relative to the handle member. The weight plates are attached removably to the adjustable member. The restricting unit includes first and second restricting members. The first restricting member is provided on one of the adjustable member and the end portion of the handle member. The second restricting member is provided on the other of the adjustable member and the end portion of the handle member. The adjustable member is rotatable relative to the handle member between a first angular position, where the first and second restricting members engage to each other, thereby arresting axial movement of the adjustable member relative to the handle member, and a second angular position, where the first and second restricting members are disengaged from each other, thereby permitting axial movement of the adjustable member relative to the handle member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
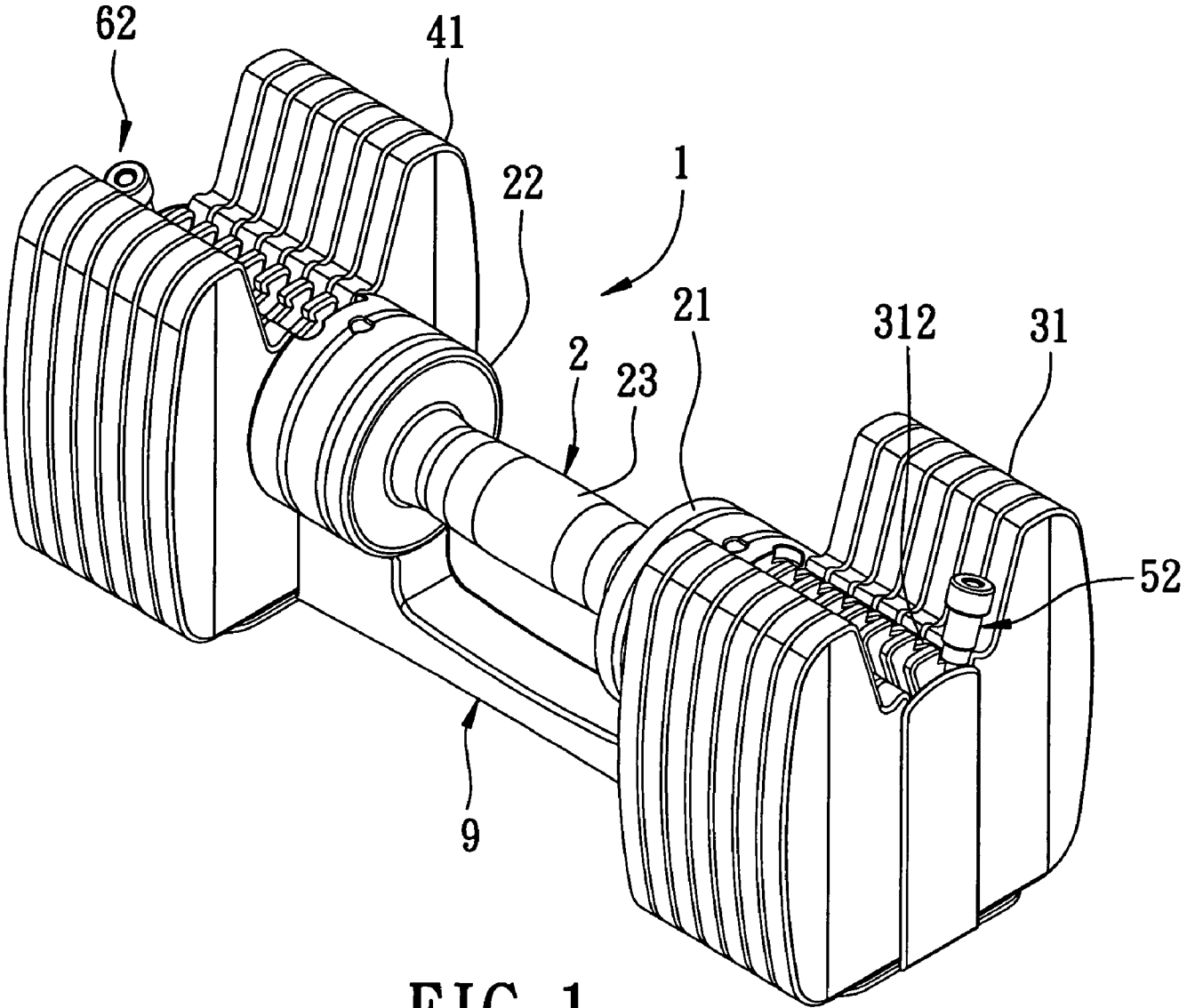
FIG. 1 is a perspective view of the first preferred embodiment of a weightlifting device according to this invention.

Before the present invention is described in greater detail, it should be noted that like elements are denoted by the same reference numerals throughout the disclosure.

Figure 2:
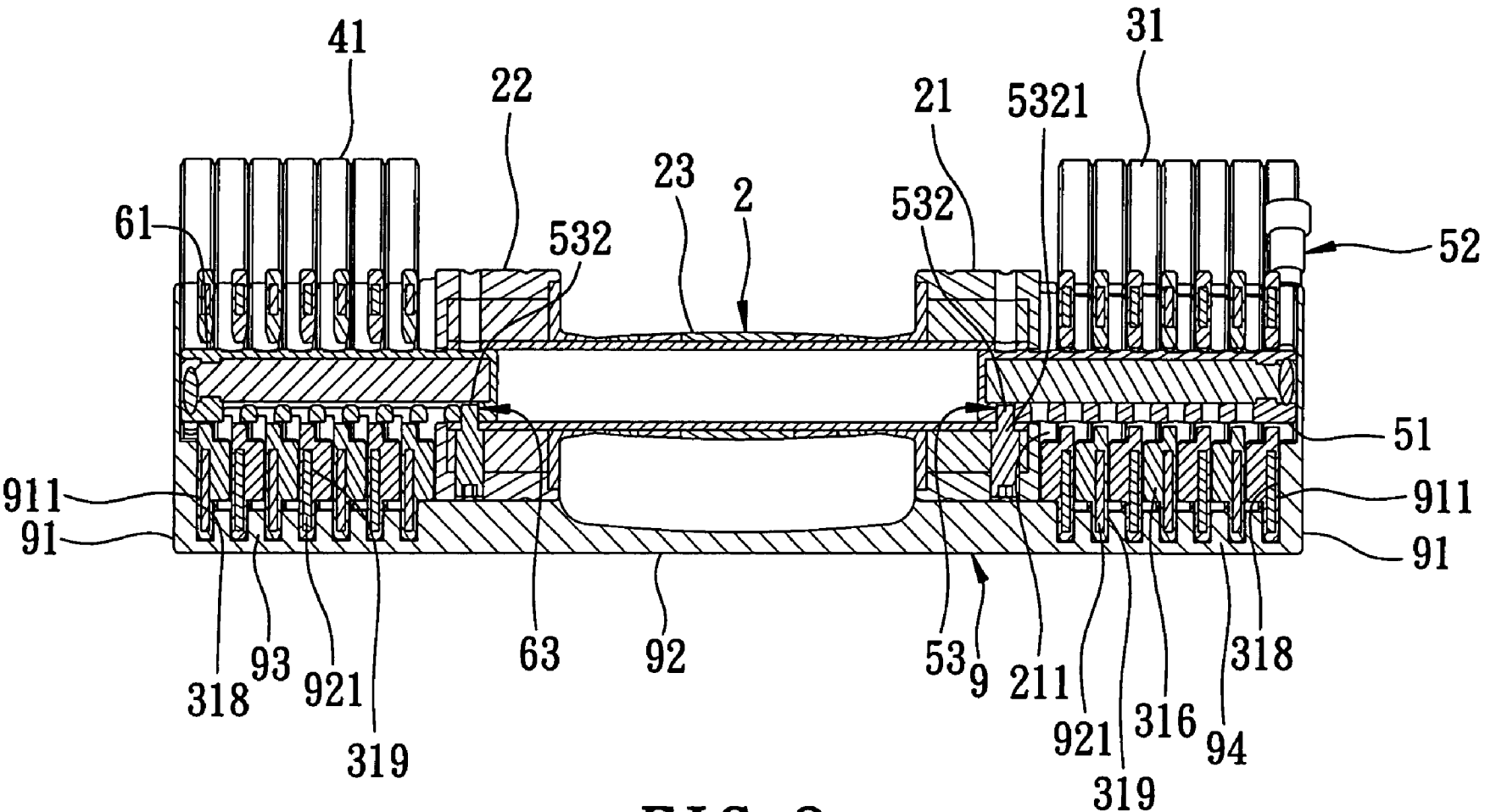
FIG. 2 is a sectional view of the first preferred embodiment.

Referring to FIGS. 1 and 2, the first preferred embodiment of a weightlifting device according to this invention is shown to include an exercising weight 1 and a rack unit 9.

The exercising weight 1 includes a handle member 2, elongated left and right adjustable members 61, 51, first and second sets of weight plates 41, 31, left and right restricting units 63, 53, and left and right retaining units 62, 52.

The handle member 2 has opposite tubular left and right end portions 22, 21, and a tubular middle portion 23 that interconnects the left and right end portions 22, 21.

Each of the left and right adjustable members 61, 51 extends into a respective one of the left and right end portions 22, 21 of the handle member 2, and is movable axially relative to the handle member 2.

The weight plates 41, 31 in each of the first and second sets is attached removably to a respective one of the left and right adjustable members 61, 51.

Each of the left and right restricting units 63, 53 serves to arrest axial movement of a respective one of the left and right adjustable members 61, 51 relative to the handle member 2.

Each of the left and right retaining units 62, 52 serves to retain the weight plates 41, 31 in a respective one of the first and second sets on a respective one of the left and right adjustable members 61, 51.

Since the constructions of the left end portion 22 of the handle member 2, the left adjustable member 61, the weight plates 41 in the first set, the left restricting unit 63, and the left retaining unit 62 are similar to those of the right end portion 21 of the handle member 2, the right adjustable member 51, the weight plates 31 in the second set, the right restricting unit 53, and the right retaining unit 52, respectively, only the right end portion 21 of the handle member 2, the right adjustable member 51, the weight plates 31 in the second set, the right restricting unit 53, and the right retaining unit 52 will be described hereinafter.

Figure 3:
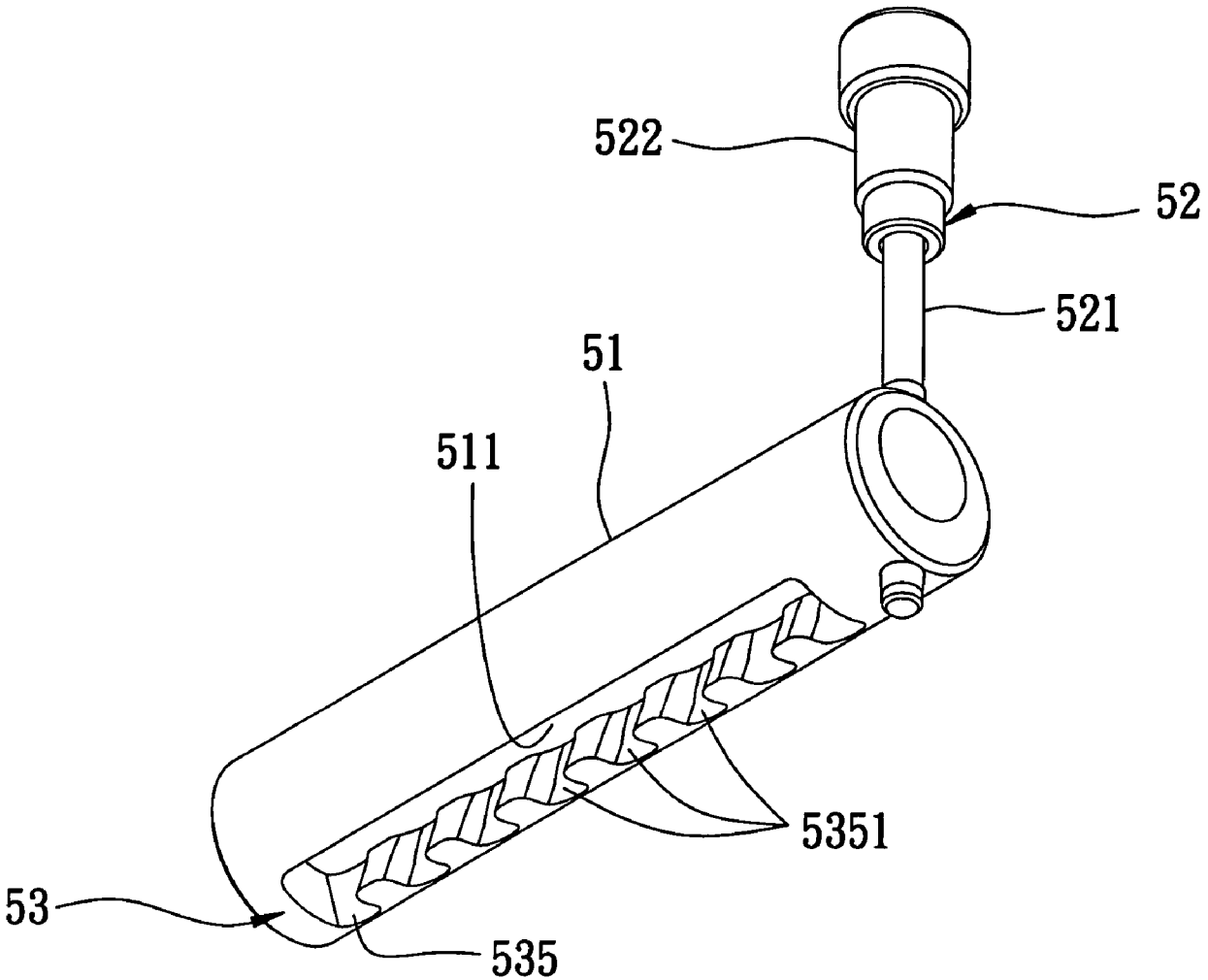
FIG. 3 is a perspective view to illustrate an adjustable member of the first preferred embodiment.

With further reference to FIG. 3, the right adjustable member 51 has a circular cross section.

The right restricting unit 53 includes a first restricting member 535 that is provided on the right adjustable member 51, and a second restricting member 532 that is provided on the right end portion 21 of the handle member 2.

The right adjustable member 51 is rotatable relative to the handle member 2 between a first angular position, where the first and second restricting members 535, 532 engage each other, thereby arresting axial movement of the right adjustable member 51 relative to the handle member 2, and a second angular position, where the first and second restricting members 535, 532 are disengaged from each other, thereby permitting axial movement of the right adjustable member 51 relative to the handle member 2.

In this embodiment, the first restricting member 535 includes a plurality of spaced apart engaging grooves 5351 that are formed in and that are disposed along the length of the right adjustable member 51. The right adjustable member 51 is formed with a guiding groove 511 that extends along the length thereof and that is in spatial communication with the engaging grooves 5351. The second restricting member 532 includes an engaging protrusion 5321 that is formed on an inner wall of the right end portion 21 of the handle member 2. When the right adjustable member 51 is rotated to the first angular position, the engaging protrusion 5321 of the second restricting member 532 moves out of the guiding groove 511 in the right adjustable member 51 and extends into a selected one of the engaging grooves 5351 of the first restricting member 535, thereby resulting in engagement between the first and second restricting members 535, 532. Conversely, when the right adjustable member 51 is rotated to the second angular position, the engaging protrusion 5321 of the second restricting member 532 moves out of the selected one of the engaging grooves 5351 of the first restricting member 535 and extends into the guiding groove 511 in the right adjustable member 51, thereby disengaging the first and second restricting members 535, 532 from each other.

The right retaining unit 52 includes a secured member 521 and a movable member 522. The secured member 521 of the right retaining unit 52 has a first end portion that extends through and that is secured to a distal end of the right adjustable member 51, and a second end portion opposite to the first end portion thereof. The movable member 522 of the right retaining unit 52 is coupled movably to the second end portion of the secured member 521 of the right retaining unit 52, and is movable relative to the secured member 521 between an engaging position, where the movable member 522 engages a rightmost one of the weight plates 31 when the weight plates 31 are attached to the right adjustable member 51, and a disengaging position, where the movable member 522 is disengaged from the rightmost one of the weight plates 31.

In this embodiment, each of the weight plates 31 is formed with a notch 312 in a periphery thereof. The movable member 522 of the right retaining unit 52 extends into the notch 312 in the periphery of the rightmost one of the weight plates 31 when the movable member 522 engages to the rightmost one of the weight plates 31.

Figure 4:
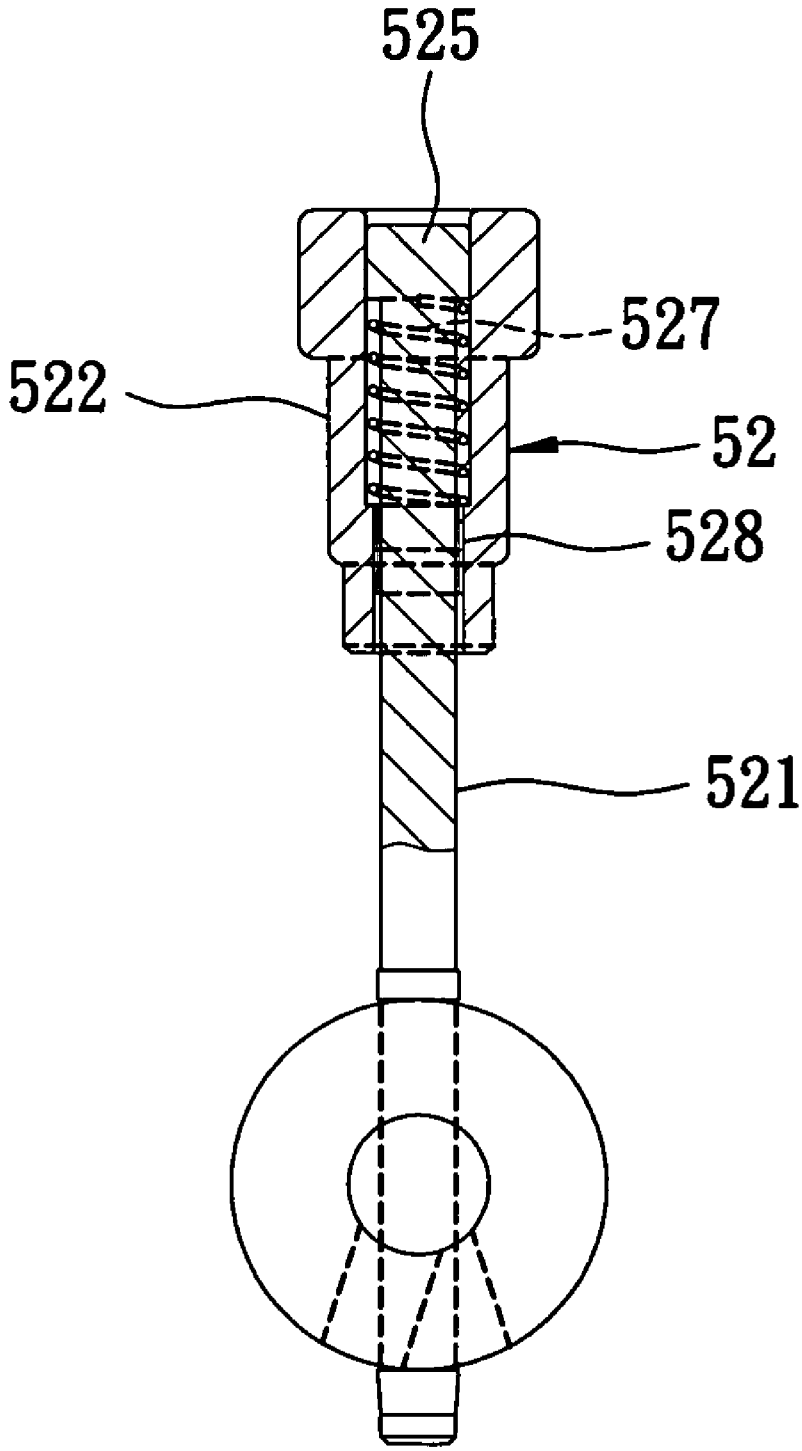
FIG. 4 is a partly sectional view to illustrate a retaining unit of the first preferred embodiment.

With further reference to FIG. 4, the right retaining unit 52 further includes a biasing member 527 for biasing the movable member 522 thereof to the engaging position. In particular, the movable member 522 of the right retaining unit 52 is hollow, and has an inner wall that is formed with an annular shoulder 528. The second end portion of the secured member 521 of the right retaining unit 52 extends into the movable member 522 and is formed with an annular shoulder 525. The biasing member 527 of the right retaining unit 52 is sleeved on the second end portion of the secured member 521, is disposed in the movable member 522, and has opposite ends that abut respectively against the annular shoulder 525 of the secured member 521 and the annular shoulder 528 of the movable member 522.

In this embodiment, the inner wall of the movable member 522 of the right retaining unit 52 is formed with an inner thread. The second end portion of the secured member 521 of the right retaining unit 52 is formed with an outer thread that threadedly engages the inner thread of the movable member 522. As such, when the movable member 522 is disposed at the engaging position, the movable member 522 may be engaged to the second end portion of the secured member 521 in order to retain the movable member 522 at the engaging position, thereby preventing accidental movement of the movable member 522 to the disengaging position.

Figure 5:
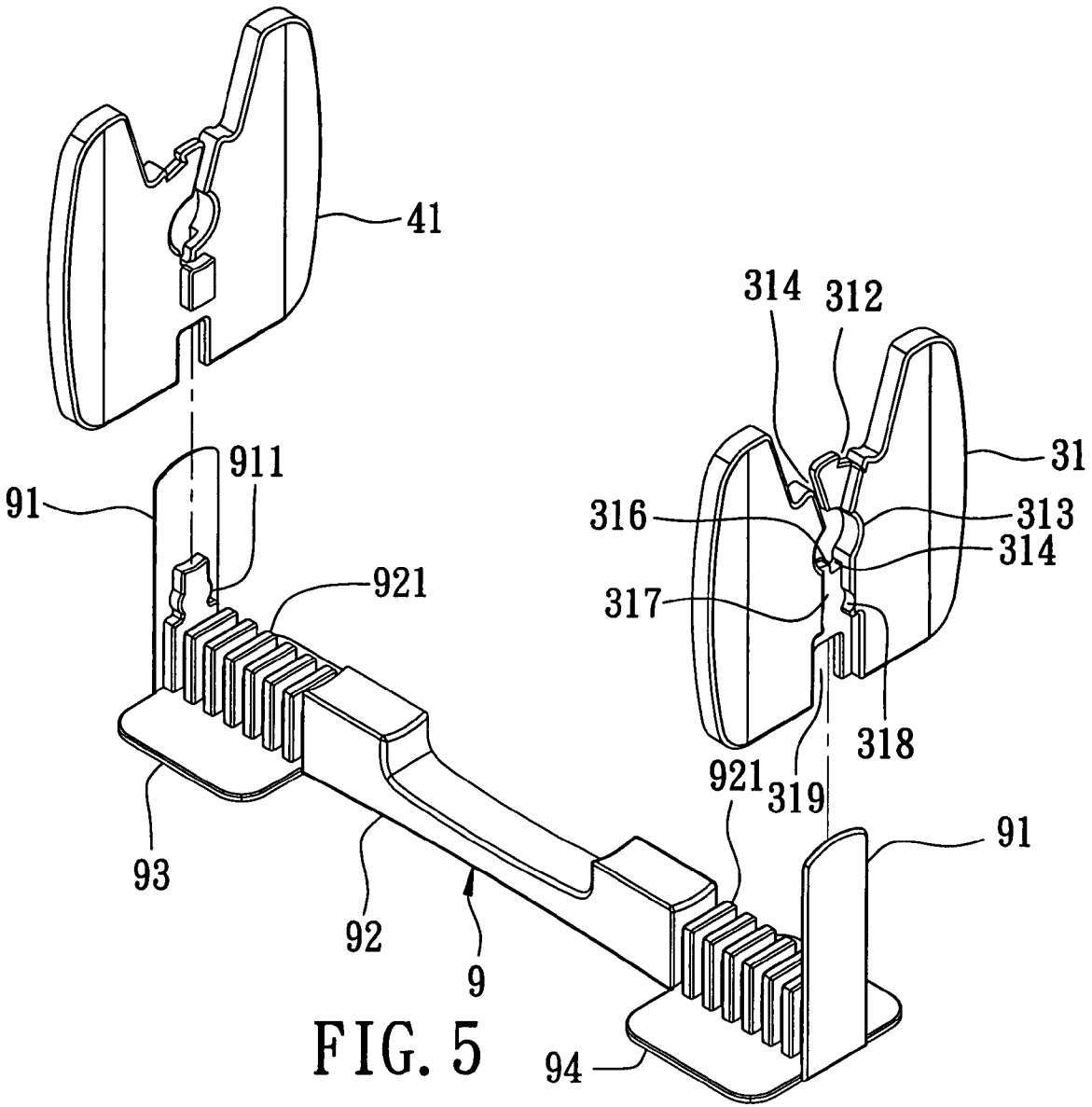
FIG. 5 is an exploded perspective view to illustrate a rack unit of the first preferred embodiment.

With further reference to FIG. 5, each of the weight plates 31 is formed with a first through-hole 313 for extension of the right adjustable member 51 therethrough. The weight plates 31 are attached to the right adjustable member 51 such that the right adjustable member 51 is extended through the first through-holes 313 in the weight plates 31.

Each of the weight plates 31 is further formed with a second through-hole 314 that is in spatial communication with the first through-hole 313 in a respective one of the weight plates 31, and that permits the right retaining unit 52 to pass therethrough when the weight plates 31 are attached to the right adjustable member 51.

Each of the weight plates 31 is further formed with a latching groove 317 and a latching protrusion 316. When the weight plates 31 are attached to the right adjustable member 51, the latching protrusion 316 of each of the weight plates 31 extends into the latching groove 317 of an adjacent one of the weight plates 31. As such, the weight plates 31 are prevented from rotating relative to each other.

Figure 6:
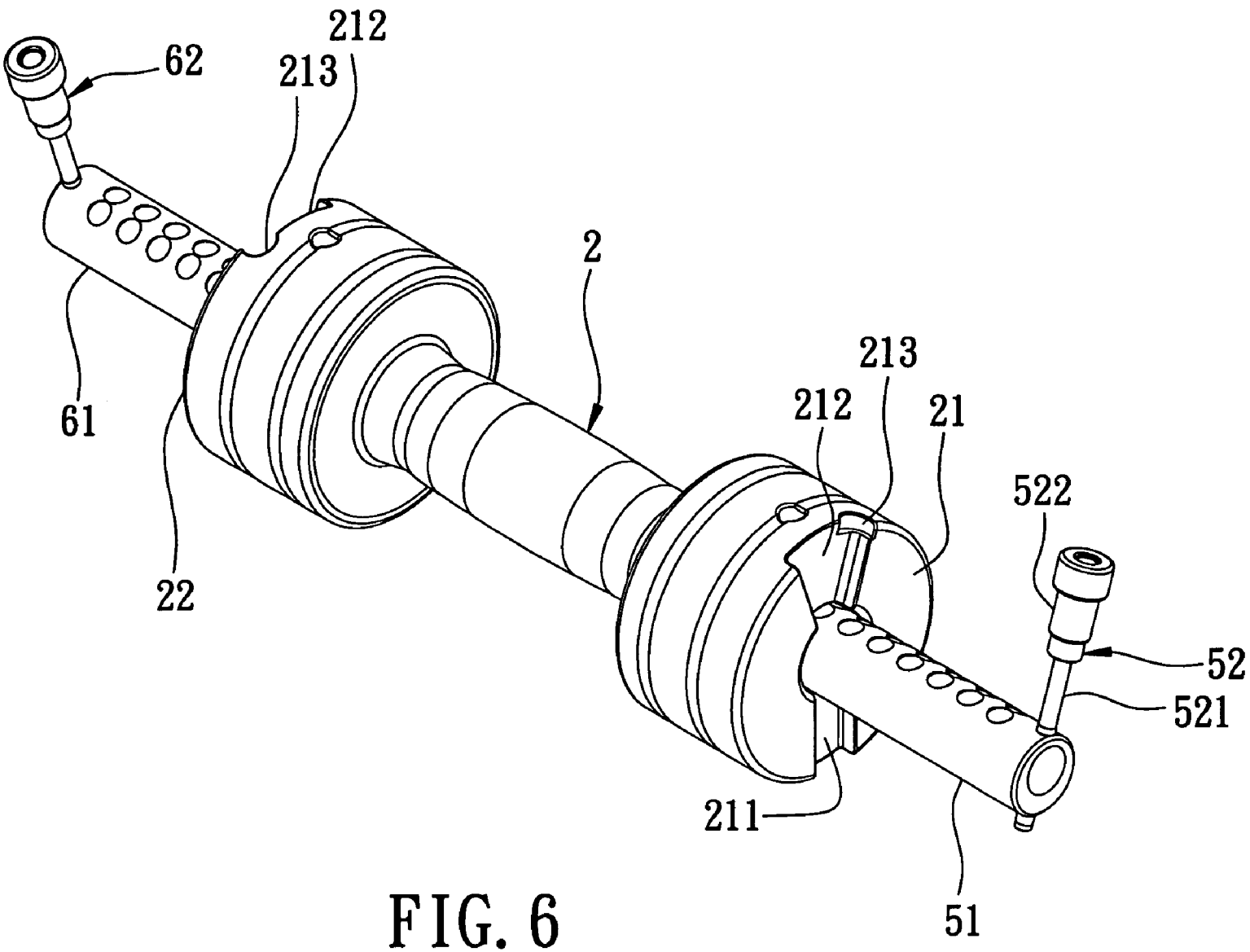
FIG. 6 is a perspective view to illustrate a handle member of the first preferred embodiment.

With further reference to FIG. 6, the right end portion 21 of the handle member 2 further has an end face that is formed with a first recess 211. When the weight plates 31 are attached to the right adjustable member 51, as best shown in FIG. 2, the latching protrusion 316 of a leftmost one of the weight plates 31 extends into the first recess 211 in the end face of the right end portion 21 of the handle member 2. As such, the weight plates 31 are prevented from rotating relative to the handle member 2.

Moreover, the end face of the right end portion 21 of the handle member 2 is further formed with a second recess 212. When none of the weight plates 31 is attached to the right adjustable member 51, the right adjustable member 51 may be retracted into the right end portion 21 of the handle member 2 such that that each of the first and second end portions of the secured member 521 of the right retaining unit 52 is received in a respective one of the first and second recesses 211, 212 in the end face of the right end portion 21 of the handle member 2.

Further, the end face of the right end portion 21 of the handle member 2 is formed with a notch 213 in a periphery thereof. When the right adjustable member 51 is retracted into the right end portion 21 of the handle member 2 and is disposed at the first angular position, and when the movable member 522 of the right retaining unit 52 is disposed at the engaging position, the movable member 522 extends into the notch 213 in the right end portion 21 of the handle member 2.

Referring back to FIG. 5, the rack unit 9 serves to support thereon the exercising weight 1. In particular, the rack unit 9 has opposite left and right end portions 93, 94, each of which supports thereon the weight plates 41, 31 in a respective one of the first and second sets, and a middle portion 92 that interconnects the left and right end portions 93, 94 thereof and that supports thereon the handle member 2.

Each of the weight plates 41, 31 is further formed with a locking groove 318. Each of the left and right end portions 93, 94 of the rack unit 9 has a distal end 91 that is provided with a locking projection 911. As best shown in FIG. 2, the locking projection 911 on the distal end 91 of the left end portion 93 of the rack unit 9 engages releasably the locking groove 318 in a leftmost one of the weight plates 41 when the left end portion 93 of the rack unit 9 supports the weight plates 41 thereon. Likewise, the locking projection 911 on the distal end 91 of the right end portion 94 of the rack unit 9 extends into the locking groove 318 in a rightmost one of the weight plates 31 when the right end portion 94 of the rack unit 9 supports the weight plates 31 thereon.

Each of the weight plates 41, 31 is further formed with a locking groove 318. Each of the left and right end portions 93, 94 of the rack unit 9 has a distal end 91 that is provided with a locking projection 911. As best shown in FIG. 2, the locking projection 911 on the distal end of the left end portion 93 of the rack unit 9 engages releasably the locking groove 318 in a leftmost one of the weight plates 41 when the left end portion 93 of the rack unit 9 supports the weight plates 41 thereon. Likewise, the locking projection 911 on the distal end of the right end portion 94 of the rack unit 9 extends into the locking groove 318 in a rightmost one of the weight plates 31 when the right end portion 94 of the rack unit 9 supports the weight plates 31 thereon.

Figure 7:
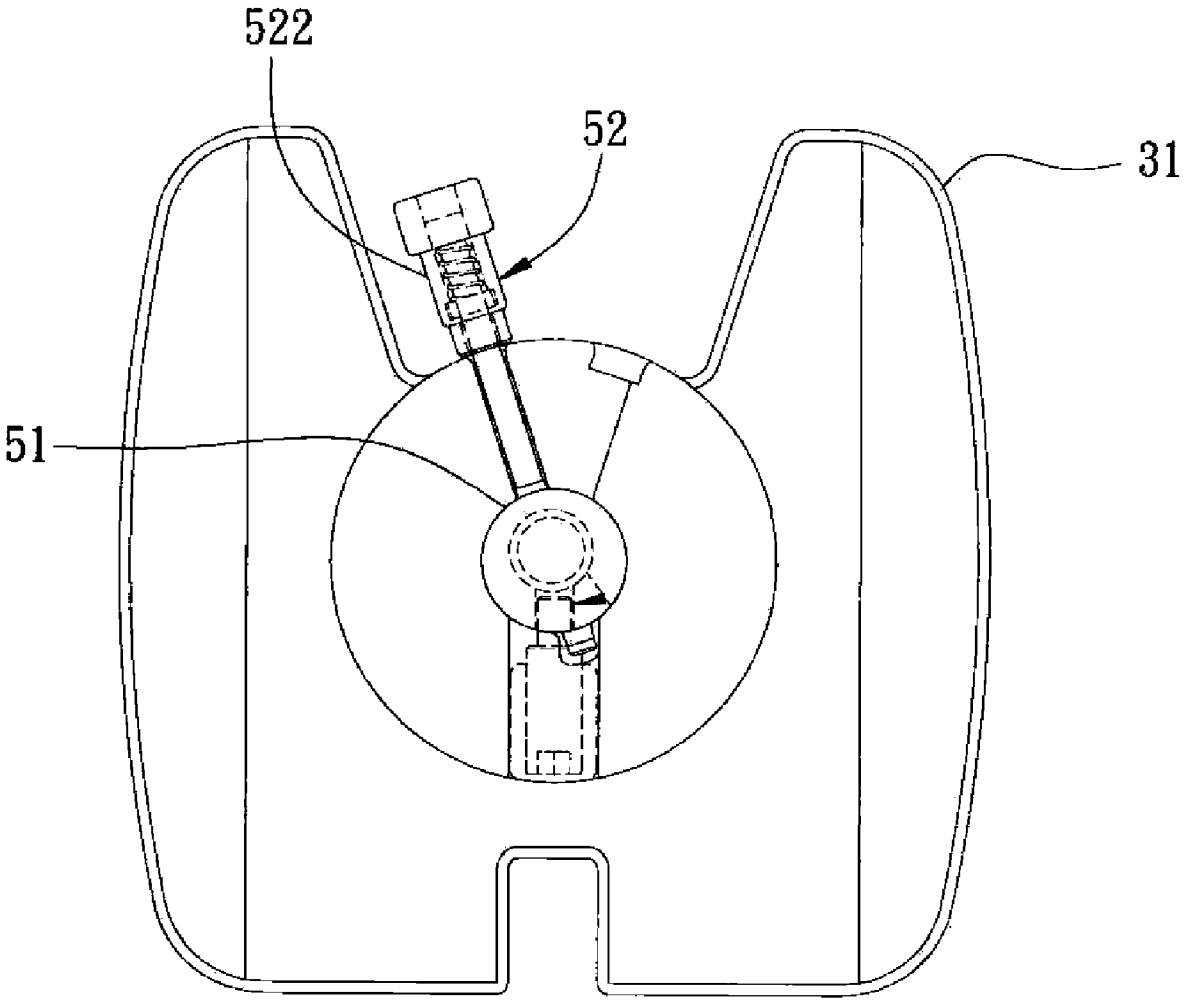
FIG. 7 is a schematic view to illustrate a state where the retaining unit of the first preferred embodiment is disposed at a disengaging position.
Figure 8:
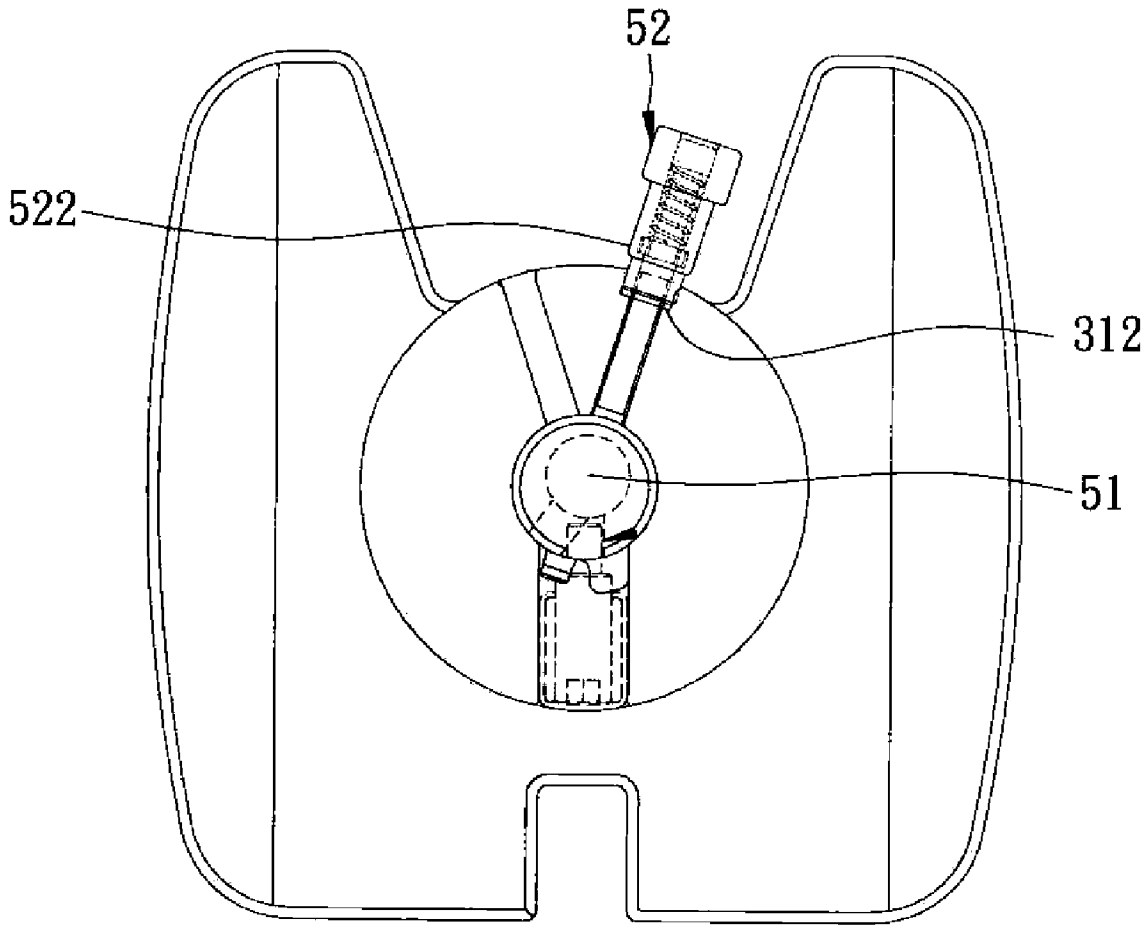
FIG. 8 is a schematic view to illustrate a state where the retaining unit of the first preferred embodiment is disposed at an engaging position.

In use, at an initial state, the rack unit 9 supports thereon the exercising weight 1. At this state, when it is desired to attach or detach the weight plates 31 to or from the right adjustable member 51, the movable member 522 of the right retaining unit 52 is first disposed at the disengaging position, and is subsequently operated to rotate the right adjustable member 51 to the second angular position, as best shown in FIG. 7. At this time, the right adjustable member 51 may be extended or retracted, via the movable member 522 of the right retaining unit 52, to add or reduce the number of the weight plates 31 attached thereon as required. As an example, when attaching two of the weight plates 31 on the right adjustable member 51, the right adjustable member 51 is extended or retracted such that the right retaining unit 52 is passed through the second through-hole 314 and is disposed adjacent to the weight plate 31 that is adjacent to the leftmost one of the weight plates 31. Thereafter, the movable member 522 of the right retaining unit 52 is operated to rotate the right adjustable member 51 to the first angular position, and is subsequently disposed at the engaging position, and is engaged threadedly to the second end portion of the secured member 521, as best shown in FIG. 8.

Since the procedure for attaching or detaching of the weight plates 41 in the first set to the left adjustable member 61 is similar to the above-described procedure, a detailed description of the same will be dispensed with herein for the sake of brevity.

Figure 9:
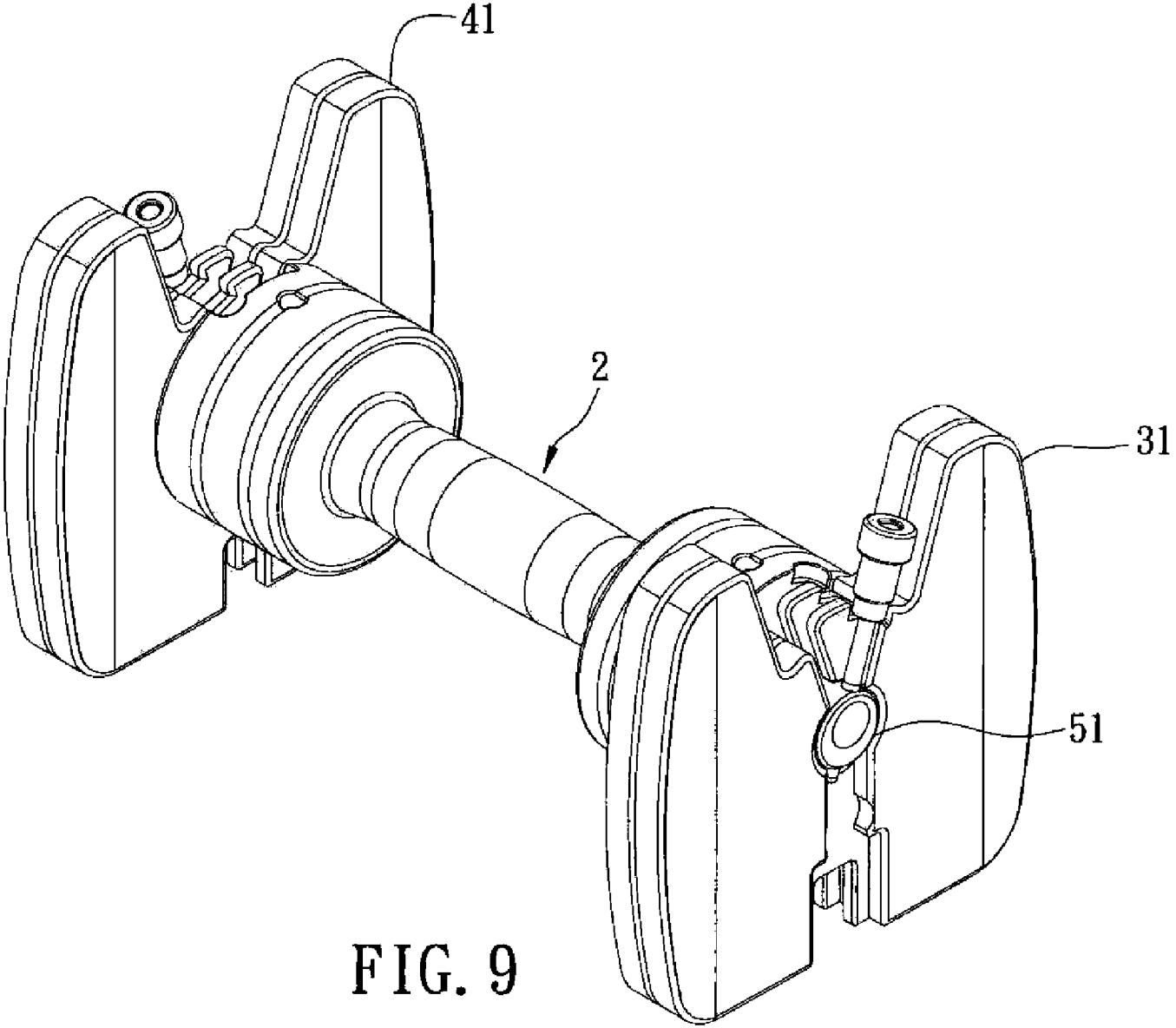
FIG. 9 is a perspective view of the first preferred embodiment to illustrate a state where the weight plates are attached to the handle member.

Once the weight plates 41, 31 in each of the first and second sets are attached to a respective one of the left and right adjustable members 61, 51, the exercising weight 1 may be lifted from the rack unit 9, as best shown in FIG. 9.

It is noted that, when all of the weight plates 41, 31 in each of the first and second sets are attached to a respective one of the left and right adjustable members 61, 51, since each of the leftmost weight plate 41 in the first set and the rightmost weight plate 31 in the second set engages the distal end 91 of a respective one of the left and right end portions 93, 94 of the rack unit 9, the rack unit 9 is likewise attached to the left and right adjustable members 61, 51. The construction as such enhances portability of the weightlifting device of this invention.

Figure 10:
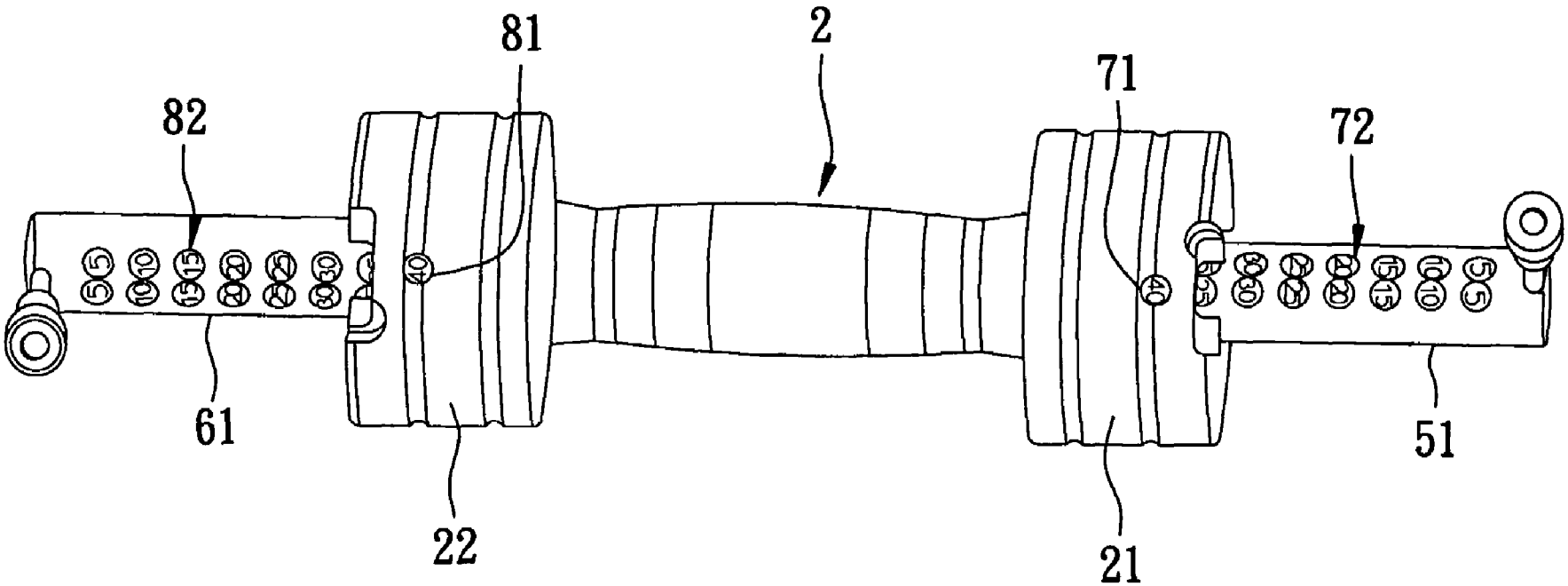
FIG. 10 is a perspective view to illustrate gradations marked on the adjustable member of the first preferred embodiment.
Figure 11:
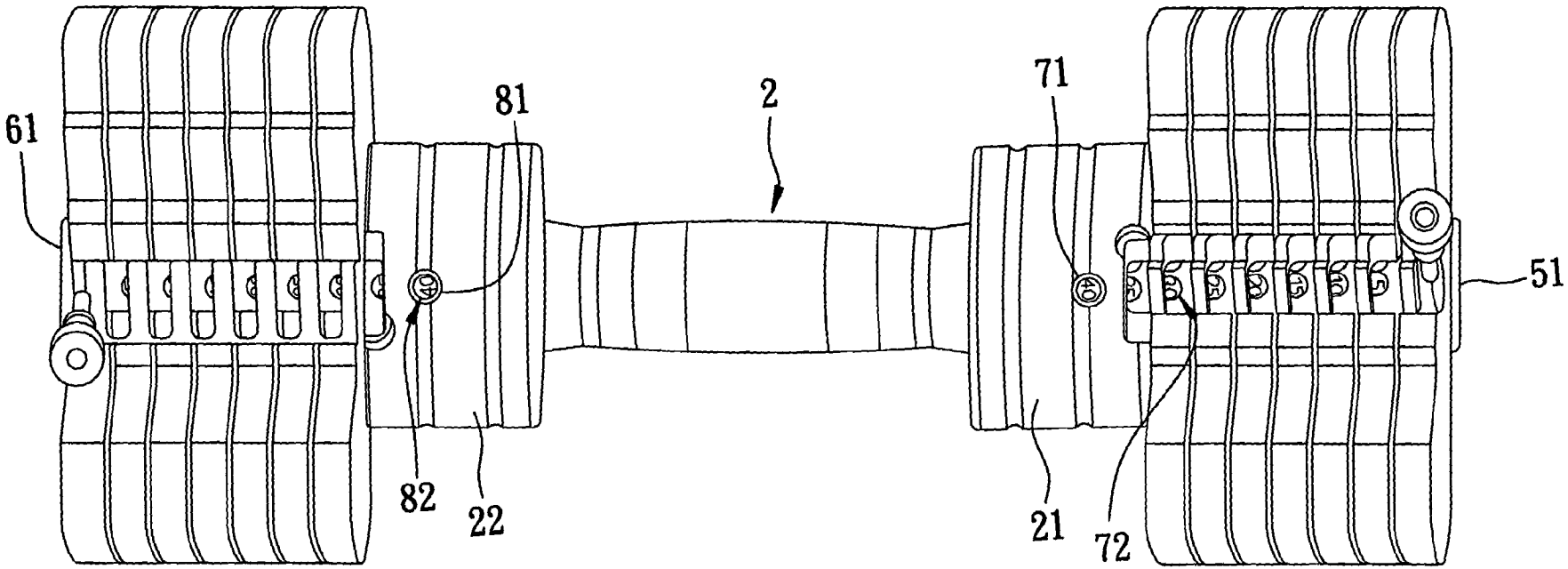
FIG. 11 is a perspective view of the first preferred embodiment to illustrate a state where one of the gradations on the adjustable member is registered with a window in the handle member.

Referring to FIG. 10, each of the left and right end portions 22, 21 of the handle member 2 is formed with a window 81, 71 therethrough. Each of the left and right adjustable members 61, 51 is marked with a plurality of gradations 82, 72. When in use, one of the gradations 82, which indicates the total weight of the weight plates 41 on the left adjustable member 61, is registered with the window 81 in the left end portion 22 of the handle member 2, as best shown in FIG. 11. Similarly, one of the gradations 72, which indicates the total weight of the weight plates 31 on the right adjustable member 51, is registered with the window 71 in the right end portion 21 of the handle member 2.

Figure 12:
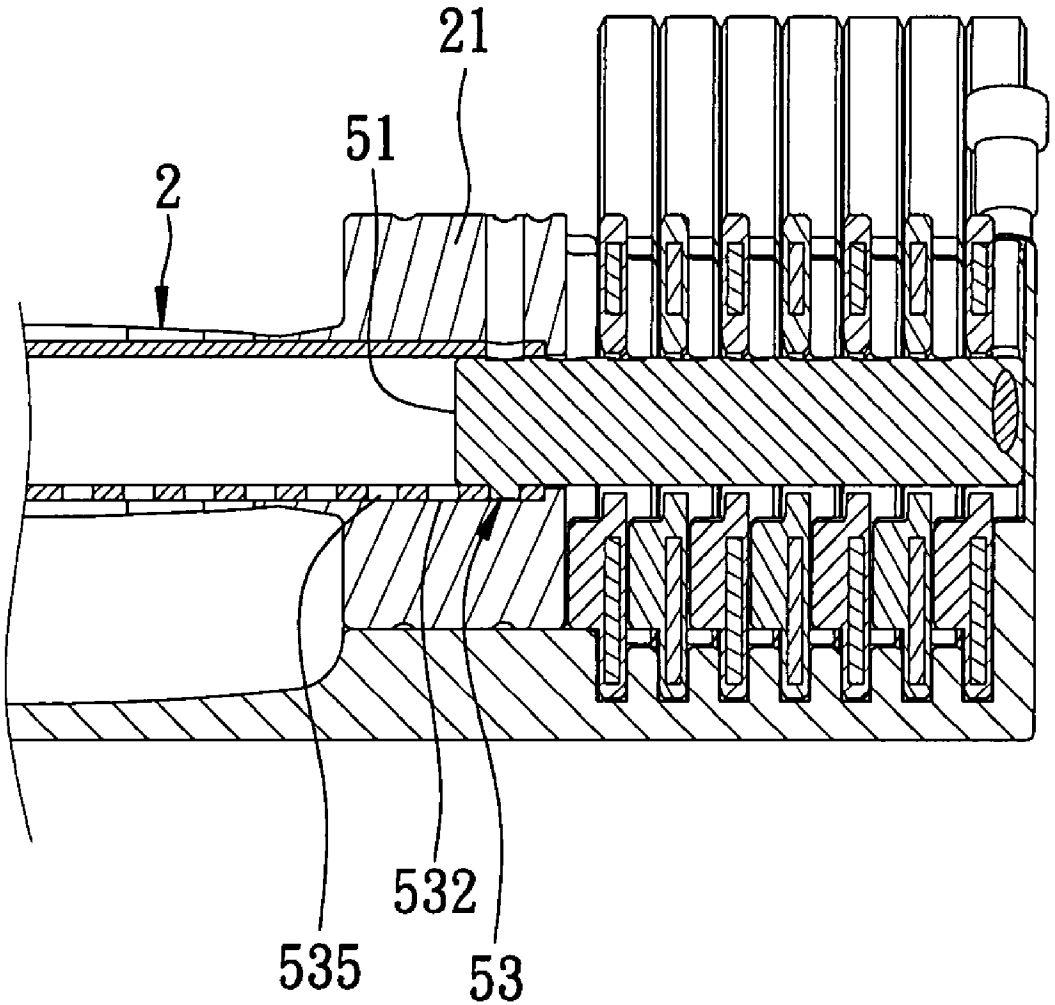
FIG. 12 is a fragmentary sectional view of the second preferred embodiment of a weightlifting device according to this invention.

FIG. 12 illustrates the second preferred embodiment of the weightlifting device according to this invention. When compared to the previous embodiment, the first restricting member 535 of the right restricting unit 53 is provided on the right end portion 21 of the handle member 2. The second restricting member 532 of the right restricting unit 53 is provided on the right adjustable member 51.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A weightlifting device, comprising:

an exercising weight including a handle member having a tubular end portion, an elongated adjustable member extending into said end portion of said handle member, and movable axially relative to said handle member, a set of weight plates attached removably to said adjustable member, and a restricting unit including a first restricting member provided on one of said adjustable member and said end portion of said handle member, and a second restricting member provided on the other of said adjustable member and said end portion of said handle member;

wherein said adjustable member is rotatable relative to said handle member between a first angular position, where said first and second restricting members engage each other, thereby arresting axial movement of said adjustable member relative to said handle member, and a second angular position, where said first and second restricting members are disengaged from each other, thereby permitting axial movement of said adjustable member relative to said handle member.

2. The weightlifting device as claimed in claim 1, further comprising a retaining unit for retaining said weight plates on said adjustable member, said retaining unit including a secured member that is coupled to said adjustable member, and a movable member that is coupled movably to said secured member, said movable member being movable relative to said secured member between an engaging position, where said movable member engages one of said weight plates when said weight plates are attached to said adjustable member, and a second position, where said movable member is disengaged from said one of said weight plates.

3. The weightlifting device as claimed in claim 2, wherein said retaining unit further includes a biasing member for biasing said movable member to the engaging position.

4. The weightlifting device as claimed in claim 3, wherein said movable member of said retaining unit is hollow, and has an inner wall that is provided with an annular shoulder, said secured member of said retaining unit extending into said movable member and being provided with an annular shoulder, said biasing member of said retaining unit being sleeved on said secured member, being disposed in said movable member, and having opposite ends that abut respectively against said annular shoulder of said secured member and said annular shoulder of said movable member.

5. The weightlifting device as claimed in claim 2, wherein said movable member of said retaining unit is hollow, and has an inner wall that is formed with an inner thread, said secured member of said retaining unit being formed with an outer thread that threadedly engages said inner thread of said movable member when said movable member is disposed at the engaging position to thereby retain said movable member at the engaging position.

6. The weightlifting device as claimed in claim 2, wherein each of said weight plates has a periphery that is formed with a notch, said movable member of said retaining unit extending into said notch in said periphery of one of said weight plates when said movable member engages said one of said weight plates.

7. The weightlifting device as claimed in claim 2, wherein each of said weight plates is formed with a first through-hole for extension of said adjustable member therethrough to thereby attach said weight plates to said adjustable member.

8. The weightlifting device as claimed in claim 7, wherein each of said weight plates is further formed with a second through-hole that is in spatial communication with said first through-hole in said weight plate, and that permits said retaining unit to pass therethrough when said weight plates are attached to said adjustable member.

9. The weightlifting device as claimed in claim 1, wherein said first restricting member includes a plurality of spaced apart engaging grooves, said second restricting member including an engaging protrusion that extends into a selected one of said engaging grooves when said adjustable member is disposed at the first angular position, and that moves out of said selected one of said engaging groove when said adjustable member is disposed at the second angular position.

10. The weightlifting device as claimed in claim 1, wherein said adjustable member has a circular cross section, each of said weight plates being formed with a latching groove and a latching protrusion, said latching protrusion of each of said weight plates extending into said latching groove of an adjacent one of said weight plates when said weight plates are attached to said adjustable member, thereby preventing rotation of said weight plates relative to each other.

11. The weightlifting device as claimed in claim 10, wherein said end portion of said handle member has an end face that is formed with a recess, said latching protrusion of one of said weight plates extending into said recess in said end face of said end portion of said handle member when said weight plates are attached to said adjustable member, thereby preventing rotation of said weight plates relative to said handle member.

12. The weightlifting device as claimed in claim 2, wherein said end portion of said handle member has an end face that is formed with a recess, said secured member of said retaining unit being received in said recess when none of said weight plates is attached to said adjustable member and when said adjustable member is retracted into said end portion of said handle member.

13. The weightlifting device as claimed in claim 1, further comprising a rack unit for supporting said exercising weight thereon.

14. The weightlifting device as claimed in claim 13, wherein each of said weight plates is formed with a locking groove, said rack unit being provided with a locking projection that engages releasably said locking groove in one of said weight plates when said rack unit supports said weight plates thereon.

15. The weightlifting device as claimed in claim 13, wherein each of said weight plates is formed with a slot, said rack unit being provided with a plurality of projections, each of which extends into said slot in a respective one of said weight plates when said rack unit supports said weight plates thereon.

16. The weightlifting device as claimed in claim 1, wherein said end portion of said handle member is formed with a window, said adjustable member being marked with a plurality of gradations, one of which is registered with said window in said end portion of said handle member for indicating a total weight of said weight plates when said weight plates are attached to said adjustable member.

* * * * *